United States Patent [19]

Lott

[11] 4,261,081

[45] Apr. 14, 1981

[54] SHOE LACE TIGHTENER

[76] Inventor: Parker M. Lott, Box 24, Stow, N.Y. 14785

[21] Appl. No.: 41,983

[22] Filed: May 24, 1979

[51] Int. Cl.[3] ..... A43C 7/00; F16G 11/00

[52] U.S. Cl. ..... 24/117; 24/71.2; 242/107.4 R

[58] Field of Search ..... 24/71.3, 71.2, 71.1, 24/68 SK, 69 SK, 71 SK, 70 SK, 117, 269; 36/50; 242/107.4 R, 107.6

[56] References Cited

U.S. PATENT DOCUMENTS

| | | | |
|---|---|---|---|
| 737,769 | 9/1903 | Preston | 242/107.4 R |
| 797,076 | 8/1905 | Schultz | 242/107.4 R |
| 1,090,438 | 3/1914 | Worth et al. | 24/117 R |

*Primary Examiner*—Alexander Grosz

*Attorney, Agent, or Firm*—Ralph Hammar

[57] ABSTRACT

A shoe lace tightener in which a housing open at the top and back and closed at the front, sides and bottom has a spindle extending from front to back on which the hub of a reel for a shoe lace is journaled. A spring biases the reel in the direction to retract the lace by winding on the reel. A lever at the top of the housing unlocks the lace to permit winding and unwinding of the lace and locks the lace in the desired position. A clip with sides straddling the side walls of the case has a back section partially closing the back of the case and holding the hub and lever in the case.

1 Claim, 12 Drawing Figures

SHOE LACE TIGHTENER

Figure 1:
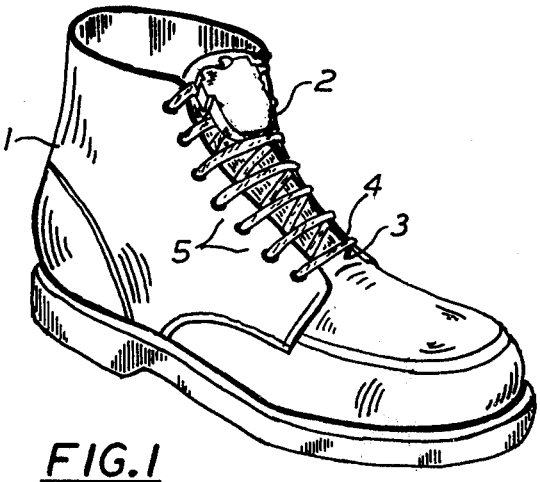
Figure 12:
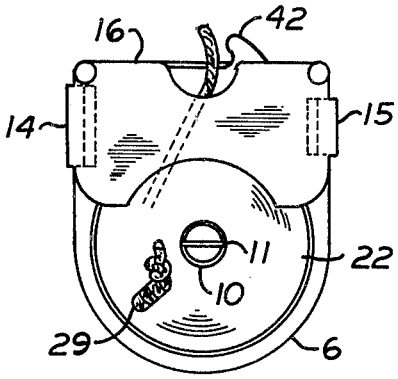
Figure 11:
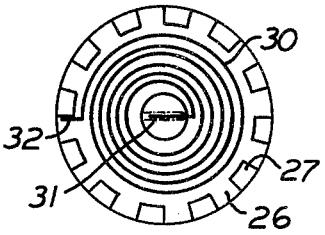
Figure 3:
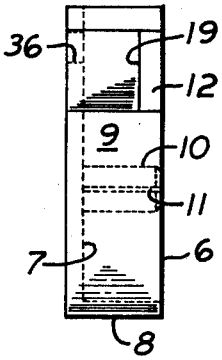
Figure 2:
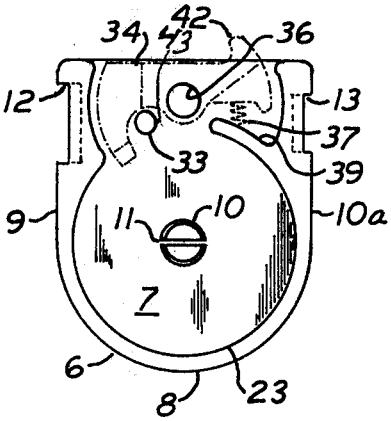
Figure 4:
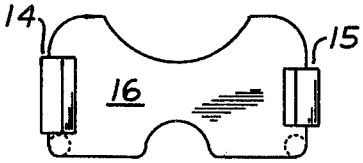
Figure 6:
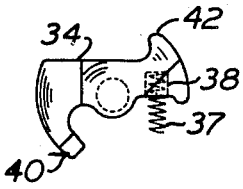
Figure 9:
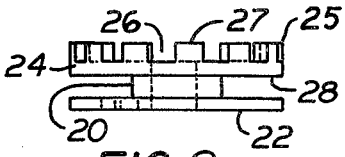
Figure 5:
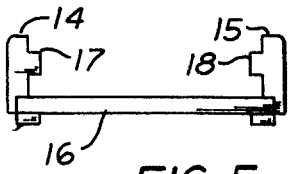
Figure 7:
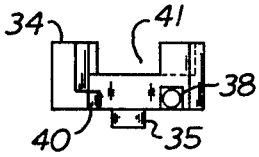
Figure 10:
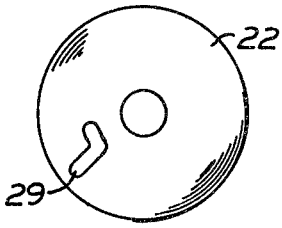

This invention is a shoe lace tightener which requires only one hand operation for loosening or tightening a lace and for holding the desired tension or tightness of the lace. In the drawing FIG. 1 is a perspective of a shoe equipped with the shoe lace tightener, FIG. 2 is a bottom view of the case, FIG. 3 is a side elevation of the case, FIG. 4 is a top plan view of the clip for holding the parts assembled in the case, FIG. 5 is an edge view of the clip, FIG. 6 is a bottom view of the lever for locking the reel any desired position, loose or tight and for releasing the rotor or reel to permit loosening of the lace, FIG. 7 is an edge view of the FIG. 6 lever, FIG. 8 is a bottom view of the detent structure for holding the lace in the selected position, FIG. 9 is an edge view of FIG. 8 showing the reel on which the lace is wound, FIG. 10 is a plan view of the flange which holds one end of the lace and which cooperates with the detent member of FIGS. 8 and 9 to provide a reel upon which the lace is wound, FIG. 11 is a plan view of the spring and associated detent structure for returning the lace to the tightened position, and FIG. 12 is a bottom view of the tightener.

In the drawing, 1 indicates a show having an upper with a laced section. One end of the shoe lace is anchored in the tightening device 2 in a manner hereinafter described. The other end 3 of the shoe lace is anchored to the shoe in eyelet 4. In the laced section 5, the lace extending from the tightening device starts at the top eyelet on the shoe and extends in zigzag fashion through the eyelets. It should be noted that when the lacing is finished only one end of the shoe lace extends from the laced section into the lace tightening device 2.

The tightener is mounted in a housing 6 of molded plastic having a top surface 7. Surface 7 may be medallion or ornamental surface. Semi-cylindrical bottom wall 8 and side walls 9, 10*a* all outstand from the top wall. At the center of the semi-circular part of the top is a spindle 10 molded integral with the top wall 7 and extending from the top wall toward the bottom of the housing. The spindle has a slot 11 for one end 31 of a coil spring (FIG. 11) which provides the power winding up the slack lace. At the top of the case are notches 12, 13 for legs 14, 15 of a clip 16 which extends across the upper end of the case. The clip has detent projections 17, 18 on the arms 14, 15 which extend beneath locking shoulders 19 on the side walls 9, 10*a*. The clip when installed partially closes the bottom of the case and holds the parts in assembled relation.

Figure 8:
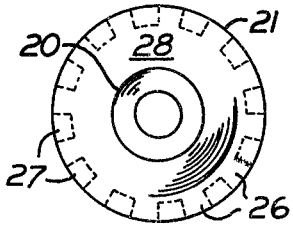

Journaled on the spindle 10 is the hub 20 of locking member 21 (FIG. 8). At the bottom end of the hub 20 is cemented a disc 22 (FIG. 9) concentric with the spindle 10 and hub 20 and having a running clearance with the cylindrical bore 23 defined by the semi-cylindrical wall 8 and the extensions thereof along the side walls 9, 10*a*. Other structure may be used for fastening the disc and hub. At the top of the hub 20 is a web 24 having at its outer periphery a forwardly extending cylindrical flange 25 having equally spaced detent recesses 26 and teeth 27 formed therein. The back side 28 of the web 24 is spaced from the front side of the flange 22 a distance sufficient to provide a reel upon which one end of the shoe lace may be wound. Telescoped within the flange 25 is a coil spring 30 having one end 31 extending through the slot 11 in the spindle 10 and having the other end 32 hooked over one of the teeth 27.

In the assembly, the flange 22 is first fastened to the outer or bottom end of the hub 20. The coil spring 30 is then assembled within the flange 25 with the end 32 hooked over one of the teeth 27 on the flange 25. The hub 20 is then telescoped over the spindle 10 after first aligning the end 31 of the spring with the slot 11 in the spindle. Control lever 34 (FIGS. 6 and 7) is then mounted in the upper end of the case by means of integral pintle 35 which is journaled at 36 in the top wall 7 of the case. Control lever 34 is shown in dotted lines in FIG. 2. When mounted on the case, a coil spring 37 having its upper end seated in a socket 38 on the under side of the lever 34 engages wall 39 of the casing and biases the lever 34 in a counterclockwise direction when viewed from the bottom so that its pointed end 40 is held in one of the detent notches 26 in the flange 25. In this position the hub 20 and the parts mounted thereon are locked to the casing 6 and cannot turn. The assembly is completed by installing the clip (FIGS. 4 and 5) in the upper end of the casing. The front wall of the clip 16 holds the lever 34 in assembled relation to the casing and also overlaps the upper edge of the flange 22 so that the hub 20 and the parts carried thereby cannot come off the spindle 10.

The lace is preferably a length of 0.055″ diameter nylon cord which has sufficient abrasion resistance and strength to outwear most shoe laces. This lace has a knot in one end or a bulge formed in that end so that when the lace is inserted through the slot 29 in the flange it can be pulled through the flange only up to the knot or bulge in the end of the lace. The other end of the lace is plain or may have a tipped end for ease of threading the lace through the eyelets of the shoe. (The tip can be thermally formed in the nylon braid or be otherwise treated to prevent the end of the braid from flaring.)

Before installing the lace the spring 30 in the device is wound by releasing the lever 34 and then winding the bottom flange four revolutions counterclockwise (or clockwise if the device is held in the position shown in FIG. 12). This spring tension is then held by engaging the pointed end 40 of the lever in the detent flange. Next the tip (or plain) end of the lace is entered through the slot 29 (FIG. 10) which is aligned with the way 43 in the case and passes under the clip as shown in FIG. 12. Then the lace is pulled out until the bulged or knotted end reaches slot 29. The lace now extends out through the top of the case to the right of guide pin 33 as viewed in FIG. 2. Next the lace is entered in the top eyelet of the shoe and laced through the eyelets and firmly anchored in eyelet 4 (FIG. 1).

Assuming first that the device is in the tightened position where the bottom of the device lies generally flat against the shoe upper as shown in FIG. 1, the size of the tightener is small enough, little more than the diameter of a 25¢ piece and about ⅜″ thick so that it does not interfere with the wearing of the shoe. The parts of the tightener are all injection molded of impact resistant thermoplastic so that the device is essentially indestructible under the conditions in use.

Assuming that the tightening device and shoe lace have been installed and the user has put on the shoe, to tighten the lace he would pull on the device. Usually this would pull about 6″ of lace out from the shoe. Then he would push down on finger extension 42 of lever 34 at the top of the device thereby pivoting the lever in a clockwise direction and moving the point 40 clear of the detent recess 26. This releases the drum or reel so that the spring causes it to revolve taking up the slack lace (6" or 8"). It should be explained that after a shoe lace is pulled tight this tension is held momentarily by the pressure of the shoe upper pressing the lace against the foot and also by the friction of the lace against the eyelets. This tension is held until the user flexes his foot or the tension is otherwise lost. After the reel takes up this slack the lever 34 is released so that the rotor is locked and the tension is held. To loosen the lace as when taking off the shoe the finger extension 42 of the lever is pushed releasing the rotor so that the lace can be payed out (usually 6"). Then the lever is engaged locking the rotor and thereby tacking the lace. Now the user has slack lace so that the shoe can be removed. Note that now the spring is wound up.

I claim:

1. A device for tightening and releasing a shoe lace of the type having one end extending from the upper end of the laced section of the shoe and the other end fixed to the lower end of the laced section of the shoe, said device having a front wall and bottom and side walls extending from the front wall providing a housing open at the back and top and closed at the front, sides and bottom, a spindle fixed to the front wall and extending toward the back of the housing, a hub journaled on the spindle, a disc fixed to the back of the hub and having means for anchoring said one end of the lace, a web fixed to the midsection of the hub and spaced from the disc to provide a reel on which said one end of the lace may be wound, a cylindrical rim extending from the outer periphery of the web toward the front wall, a coil spring within said rim having one end anchored to said spindle and the other end anchored to said web for turning the hub in the direction to wind the lace on the reel, a lever pivoted on said front wall at the top of the housing, said lever having a locking position to lock the lace and an unlocked position releasing the lace, spring means for biasing the lever to the locked position, a finger actuated means for moving the lever to the unlocked position, and a clip with sides straddling the side walls of the case and with a back section partially closing the back of the case and holding the hub and lever in the case.

* * * * *